US008328044B1

(12) United States Patent
Iskandar

(10) Patent No.: US 8,328,044 B1
(45) Date of Patent: Dec. 11, 2012

(54) TRAVELING MUG

(76) Inventor: Wahid Iskandar, Artarmon (AU)

( * ) Notice: Subject to any disclaimer, the term of this patent is extended or adjusted under 35 U.S.C. 154(b) by 0 days.

(21) Appl. No.: 13/220,805

(22) Filed: Aug. 30, 2011

(51) Int. Cl.
*A47G 19/22* (2006.01)
*B65D 51/18* (2006.01)

(52) U.S. Cl. ..... 220/713; 220/254.3

(58) Field of Classification Search ..... 220/502, 220/507, 713, 714, 715, 711, 555, 553, 62.12, 220/254.3, 254.1, 203.02, 203.01, 254.4, 220/705; 222/138, 129, 557, 556; *B65D 51/18*
See application file for complete search history.

(56) References Cited

U.S. PATENT DOCUMENTS

| | | | | | |
|---|---|---|---|---|---|
| 1,025,653 | A * | 5/1912 | Sims | 222/144.5 |
| 1,184,549 | A * | 5/1916 | McClung | 220/525 |
| 1,312,203 | A * | 8/1919 | Picard | 222/129 |
| 1,635,189 | A * | 7/1927 | McClure | 220/324 |
| 4,901,630 | A * | 2/1990 | Hall | 99/295 |
| 5,143,261 | A * | 9/1992 | Drobish | 222/129 |
| D342,022 | S | 12/1993 | Pritchard | |
| 5,307,950 | A * | 5/1994 | Li | 220/714 |
| 5,921,440 | A * | 7/1999 | Maines | 222/145.2 |
| 6,450,351 | B1 | 9/2002 | Thompson | |
| 6,989,168 | B2 | 1/2006 | Fahey | |
| 7,975,868 | B1 * | 7/2011 | Flies et al. | 220/524 |
| 2004/0206717 | A1 | 10/2004 | Flies et al. | |
| 2007/0181581 | A1 | 8/2007 | Ross | |
| 2008/0110899 | A1 * | 5/2008 | Gustafson | 220/553 |
| 2009/0188929 | A1 * | 7/2009 | Sims et al. | 220/710 |
| 2010/0237034 | A1 | 9/2010 | Kountotsis | |

* cited by examiner

*Primary Examiner* — Mickey Yu
*Assistant Examiner* — Robert J Hicks
(74) *Attorney, Agent, or Firm* — Kyle Fletcher

(57) ABSTRACT

The traveling mug includes a container divisible into a plurality of vertically oriented compartments. A lid attaches atop the container via securing member. The lid has a selection stem rotatably engaged about said lid, and enables access to a desired compartment upon rotation thereon. The lid has sipping sections aligned above the compartments such that upon alignment of the selection stem, an end user may sip contents there from and to the respective sipping section. The selection stem is connected to an armature positioned between the lid and a bottom disk having openings thereon; upon rotation of the selection stem and armature, covers rotate and either expose or cover the openings of the disk thereby providing access to either compartment situated there under.

4 Claims, 7 Drawing Sheets

TRAVELING MUG

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of mugs, more specifically, a sealable mug containing a plurality of vertically oriented compartments.

B. Discussion of the Prior Art

As will be discussed immediately below, no prior art discloses a traveler mug that includes container and a lid; wherein the container includes a plurality of compartments that are each vertically aligned with one another; wherein the lid is secureably engaged atop the container via securing means; wherein the lid features opposing sipping sections that align above a respective compartment that upon selection of the desired compartment enables an end user to sip from the sipping section aligned above the respective compartment; wherein the lid includes a selection stem that is rotatably engaged upon said lid and upon rotation shall expose a hole located above the compartment to be consumed from.

The Fahey Patent (U.S. Pat. No. 6,989,168) discloses a beverage container with two compartments separated by a vertical liquid-impermeable wall. However, the beverage container is not a traveler mug in which the interior is divided into multiple vertically oriented compartments that are each accessible upon rotation of the lid.

The Flies et al. Patent Application Publication (U.S. Pub. No. 2004/0206717) discloses a vertically separated, compartmentalized travel beverage container providing a consumer to select for consumption the beverage in one of the compartments. However, the travel beverage container does not include a lid that is secured atop a container and in which has a stem that upon rotation shall enable the contents of a specific compartment to be consumed.

The Ross Patent Application Publication (U.S. Pub. No. 2007/0181581) discloses a beverage mug divided into two compartments. However, the beverage mug is not a traveler container including multiple compartments that are accessible from a lid having a rotatable stem located thereon.

The Thompson Patent (U.S. Pat. No. 6,450,351) discloses a compartmented beverage container. However, the container does not have a lid that is secured atop a container and of which includes a stem that can be rotated to enable access to a particular compartment for consumption.

The Kountotsis Patent Application Publication (U.S. Pub. No. 2010/0237034) discloses a multi-chambered bottle comprising a dome cap with a single orifice, wherein the cap can be rotated to shift the orifice between two positions in order to allow individual and separate access to the first bottle opening and the second bottle opening. However, the bottle employs multiple outlet ports as opposed to a secureable lid that includes a rotatable stem to enable access to a desired compartment.

The Pritchard Patent (U.S. Pat. No. Des. 342,022) illustrates a design for a combined compartmented bottle and closure, which does not depict a lid including a stem that can rotate to enable access to a desired compartment.

While the above-described devices fulfill their respective and particular objects and requirements, they do not describe a traveler mug that includes container and a lid; wherein the container includes a plurality of compartments that are each vertically aligned with one another; wherein the lid is secureably engaged atop the container via securing means; wherein the lid features opposing sipping sections that align above a respective compartment that upon selection of the desired compartment enables an end user to sip from the sipping section aligned above the respective compartment; wherein the lid includes a selection stem that is rotatably engaged upon said lid and upon rotation shall expose a hole located above the compartment to be consumed from. In this regard, the traveling mug departs from the conventional concepts and designs of the prior art.

SUMMARY OF THE INVENTION

The traveling mug includes a container divisible into a plurality of vertically oriented compartments. A lid attaches atop said container via securing means. The lid has a selection stem rotatably engaged about said lid, and enables access to a desired compartment upon rotation thereon. The lid has sipping sections aligned above the compartments such that upon alignment of the selection stem, an end user may sip contents there from and to the respective sipping section. The selection stem is connected to an armature positioned between the lid and a bottom disk having openings thereon; upon rotation of the selection stem and armature, covers rotate and either expose or cover the openings of the disk thereby providing access to either compartment situated there under.

An object of the invention is to provide a traveling mug that includes multiple compartments that can store different beverages within and of which are accessible upon use of a selection stem.

A further object of the invention is to provide a lid that includes securing means to sealably engage the lid onto the container, which contains the compartments.

A further object of the invention is to include a lid that is divisible into sipping sections that correspond and align with the different compartments.

A further object of the invention is to include a selection stem that is rotatably engageable with the lid and of which can provide access to the compartment upon alignment of a hole located on the lid.

An even further object of the invention is to include an armature that is sandwiched between the lid and a bottom disk, and which includes covers that engage or disengage openings in the bottom disk thereby providing election of fluid communication to either compartment upon rotation of the selection stem.

An even further object of the invention is to provide at least one mouthpiece cover that can engage either sipping section of the lid when not in use.

These together with additional objects, features and advantages of the traveling mug will be readily apparent to those of ordinary skill in the art upon reading the following detailed description of presently preferred, but nonetheless illustrative, embodiments of the traveling mug when taken in conjunction with the accompanying drawings.

In this respect, before explaining the current embodiments of the traveling mug in detail, it is to be understood that the traveling mug is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the traveling mug.

It is therefore important that the claims be regarded as including such equivalent construction insofar as they do not depart from the spirit and scope of the traveling mug. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
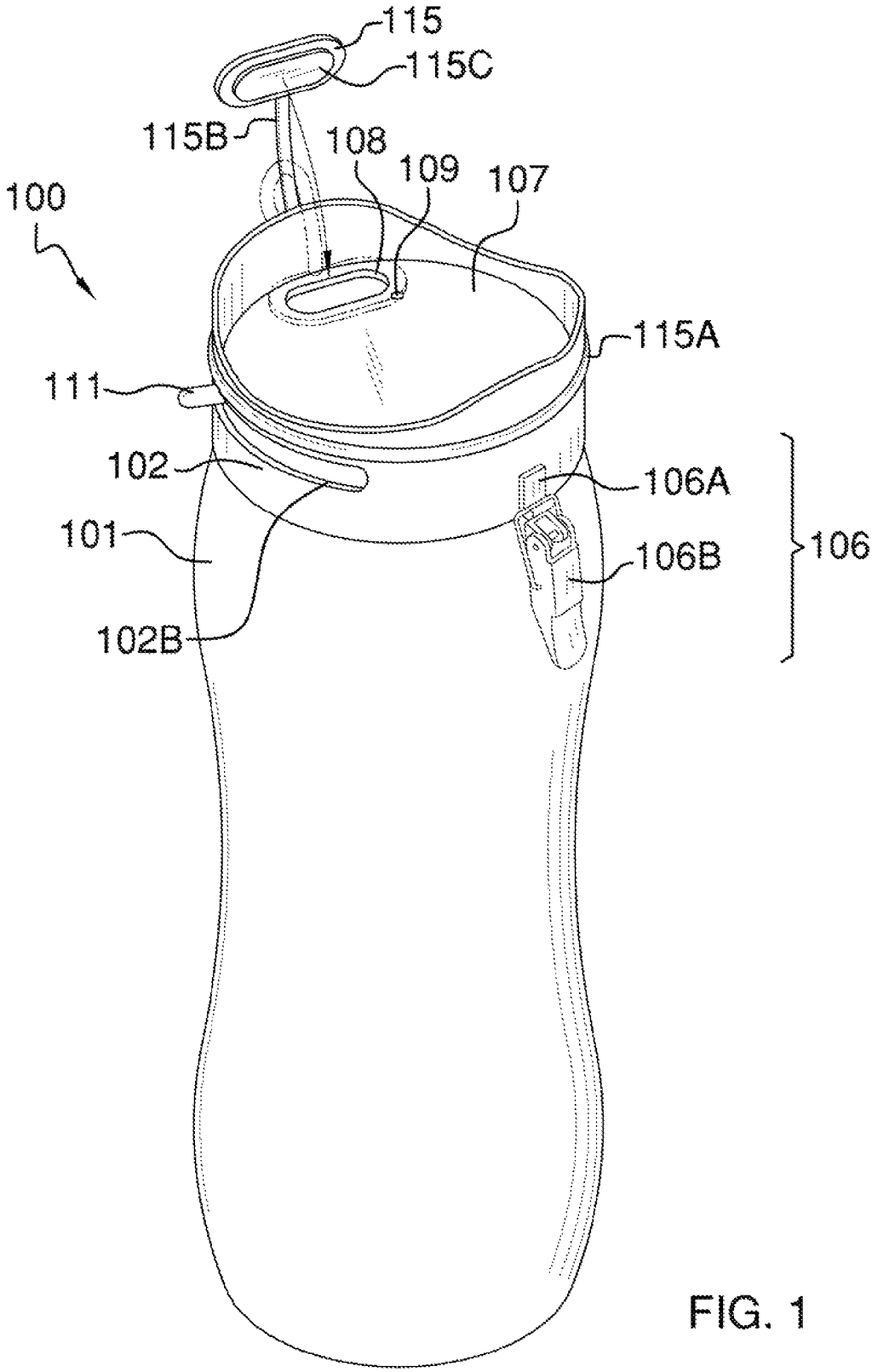
FIG. 1 illustrates a front, isometric view of the traveler mug in which the lid is secured atop the container via the securing means and in which the mouthpiece cover is depicted in either an erect orientation or as bended to cover an adjacent sipping section.
Figure 2:
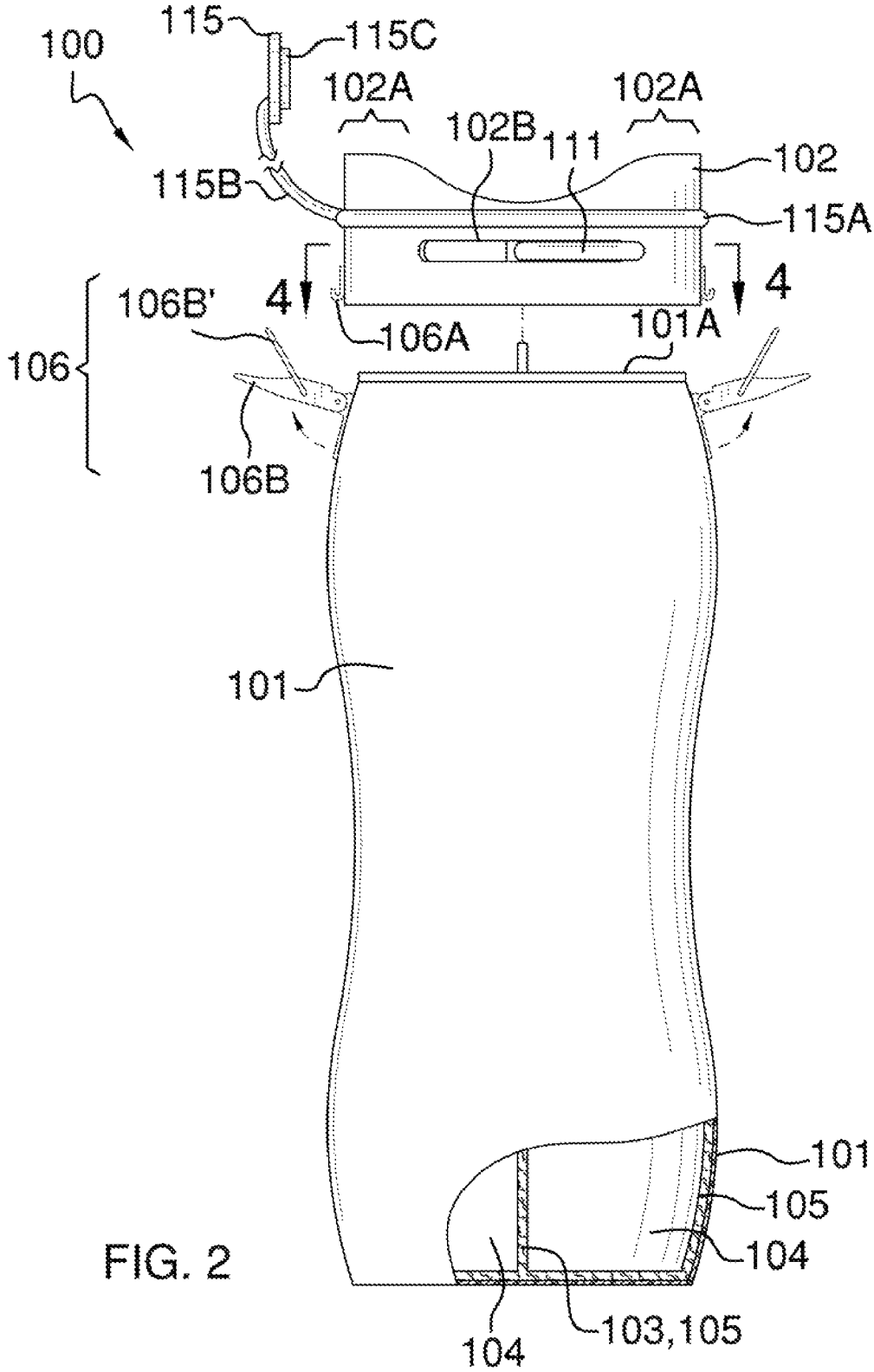
FIG. 2 illustrates a partially exploded and partial cut-away view of the traveler mug in which the lid is released and aligned above the container and detailing rotation of the securing means, and the cut-away details the divider located in the interior of the container that is responsible for forming the compartments within.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-5. A traveling mug 100 (hereinafter invention) includes a container 101, and a lid 102.

The container 101 may have a curved shape as the container 101 extends vertically. The container 101 has an interior that includes a divider 103. The divider 103 is responsible for is a main benefit of the invention 100 to include a plurality of compartments 104, which are capable of storing different beverages within and of which are not in fluid communication with one another in order to prevent mixing thereof. Also, it shall be noted that the construction of the container 101, the divider 103, and the compartments 104 is to include insulating means 105 within, which enables the temperature of a beverage 130 contained within one compartment 104 to be maintained while including a second beverage 131 in a second compartment 104 at a different temperature.

The lid 102 is secured to a top opening 101A of the container 101 via securing means 106. The securing means 106 are located on opposing sides of the invention 100, and are composed of a hook 106A and rotating latch 106B. The rotating latch 106B has a loop 106B' that hooks onto the hook 106A, and upon rotation of the rotating latch 106B the lid 102 is secured atop the container 101.

The lid 102 is divisible into sipping sections 102A that are aligned above one of the compartments 104. It shall be noted that the number of compartments 104 located within the container 101 shall be equal to the number of the sipping sections 102A located on the lid 102.

The lid 102 has a flat surface 107 that encloses the top opening 101A of the container 101, and insures that the beverages 130 and 131 do not escape the invention 100 unintentionally.

The flat surface 107 of the lid 102 includes holes 108. The holes 108 are aligned with the sipping sections 102A, which are aligned above the respective compartments 104. The holes 108 are designed to enable the beverage 130/131 to pour out of the respective compartment 104 in a laminar flow. The holes 108 each have an elongated circle shape.

The flat surface 107 of the lid 102 also includes vents 109. The vents 109 are also aligned above respective compartments 104 and respective sipping sections 102A. The vents 109 ensure that the beverage 130/131 can flow in a laminar manner, and prevents a vacuum of pressure from occurring within the compartment 104.

Located beneath the flat surface 107 of the lid 102 is an armature 110. The armature 110 can rotate about a center 102' of the lid 102. The armature 110 has a range of rotational movement that is dictated by a selection stem 111 that extends from the center 102' of the armature 110 and engages an opening 102B located on a side surface of the lid 102.

Extending from the armature 110 are hole covers 110A that extend radially from the center 102', and which are provided at a predefined arc segment, which shall correspond to the holes 108 of the lid 102 such that upon rotation of the selection stem 111, the hole covers 110A either cover or expose access to the compartments 104 contained under a bottom disk 112.

The bottom disk 112 includes bottom holes 112A and bottom vents 1128 that correspond with and are aligned beneath the holes 108 and vents 109 of the lid 102. The bottom disk 112 also includes a selection stem hole 112C, which enables the selection stem 111 to rotate about the center 102'. It shall be noted that the bottom disk 112 essentially seals off the compartments 104 located there under.

The hole covers 110A of the armature 110 each include an elevated section 110B, which extends downwardly therefrom, and which shall engage into the respective bottom holes 112A, and which can provide an airtight seal there with.

Figure 4A:
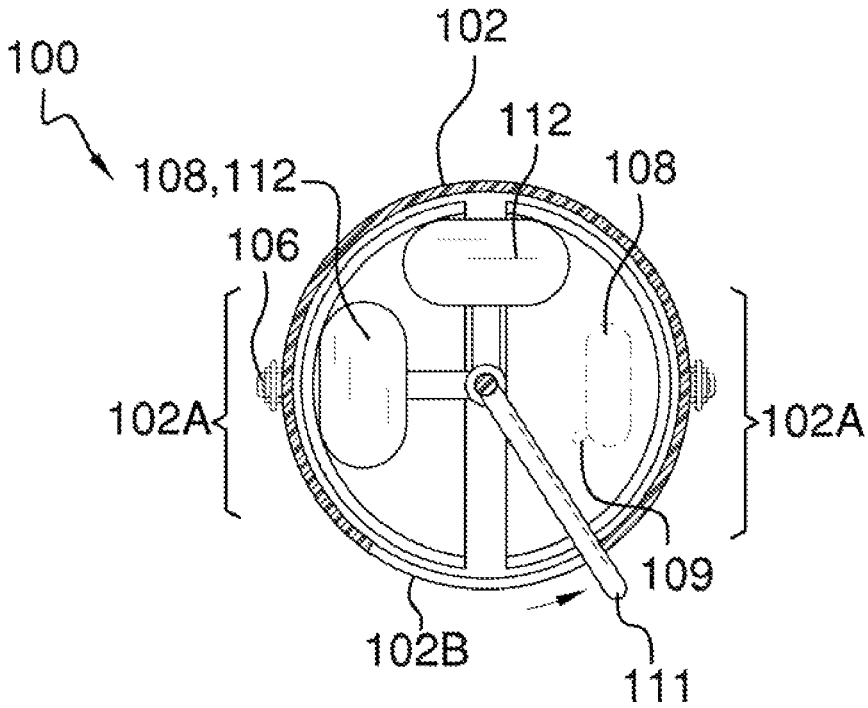
FIG. 4A illustrates a cross-sectional view along line 4-4 in FIG. 2, and depicting rotation of the selection stem and armature there by uncovering of an opening located on the bottom disk as well as a cross-brace that supports said armature therein.
Figure 4B:
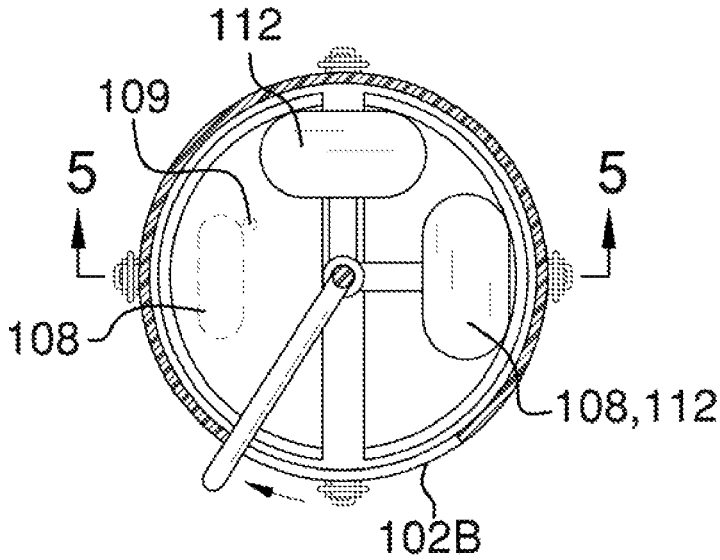
FIG. 4B illustrates a cross-sectional view along line 4-4 in FIG. 2, and depicting rotation of the selection stem and armature to an opposing position, which uncovers a second opening located on the bottom disk and which is aligned with a second sipping section of the lid.

Upon rotation of the selection stem 111 to a side of the opening 102B, one bottom hole 112A and one bottom vent 112E shall seal off a corresponding hole 108 and vent 109 (see FIGS. 4A-4B). Coincidentally, an opposing hole 108 and vent 109 is exposed, and the respective sipping section 102A and compartment 104 is available for drinking the respective beverage 130/131. More the point, upon rotation of the selection stem 111 to an opposite end of the opening 1028 shall result in sealing the exposed hole 108 and vent 109, and conversely un-exposing of the covered hole 108 and vent 109.

The armature 110, the bottom disk 112, and the selection stem 111 create a main benefit of the invention 100 in that an end user can select the desired beverage 130/131 in the desired compartment 104 for consuming by moving the selection stem 111 accordingly.

Figure 3:
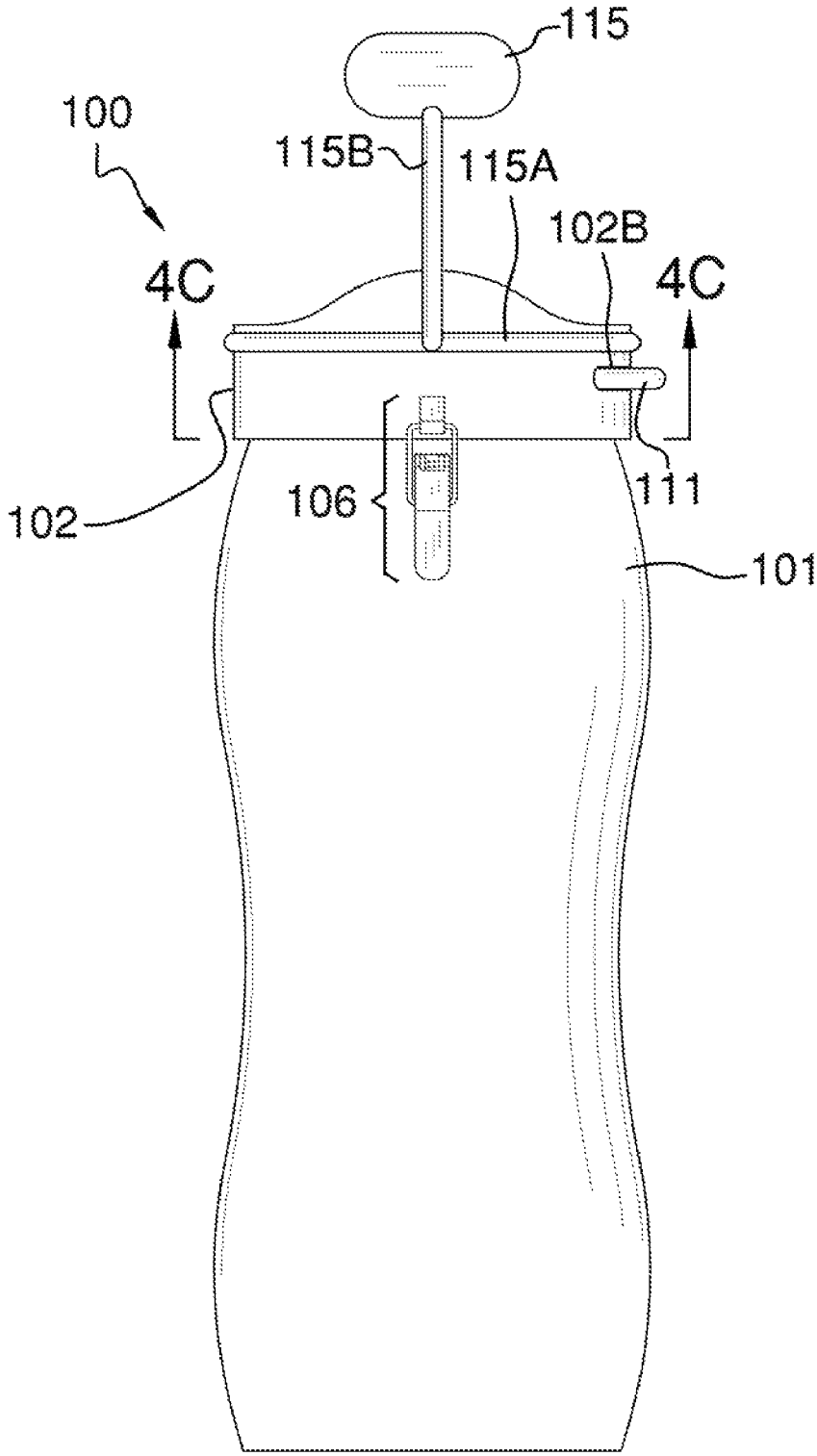
FIG. 3 illustrates a front view of the traveler mug wherein the mouthpiece cover is erect.
Figure 4C:
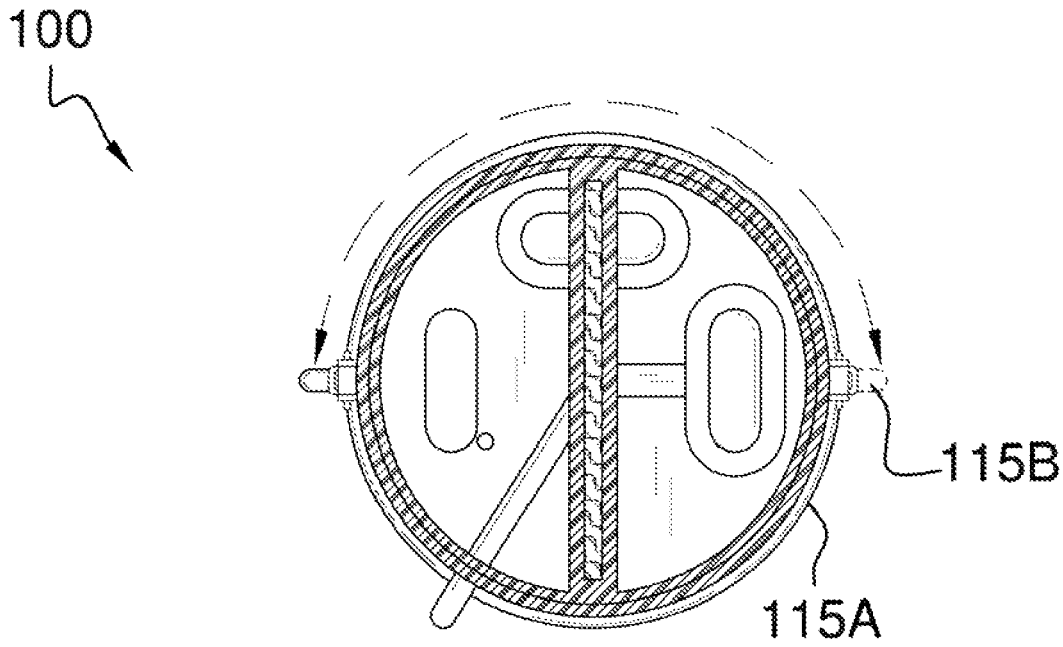
FIG. 4C illustrates a cross-sectional view along line 4C-4C in FIG. 3, and detailing the rubber band encircling an outer periphery of said lid and which supports the mouthpiece cover.
Figure 4D:
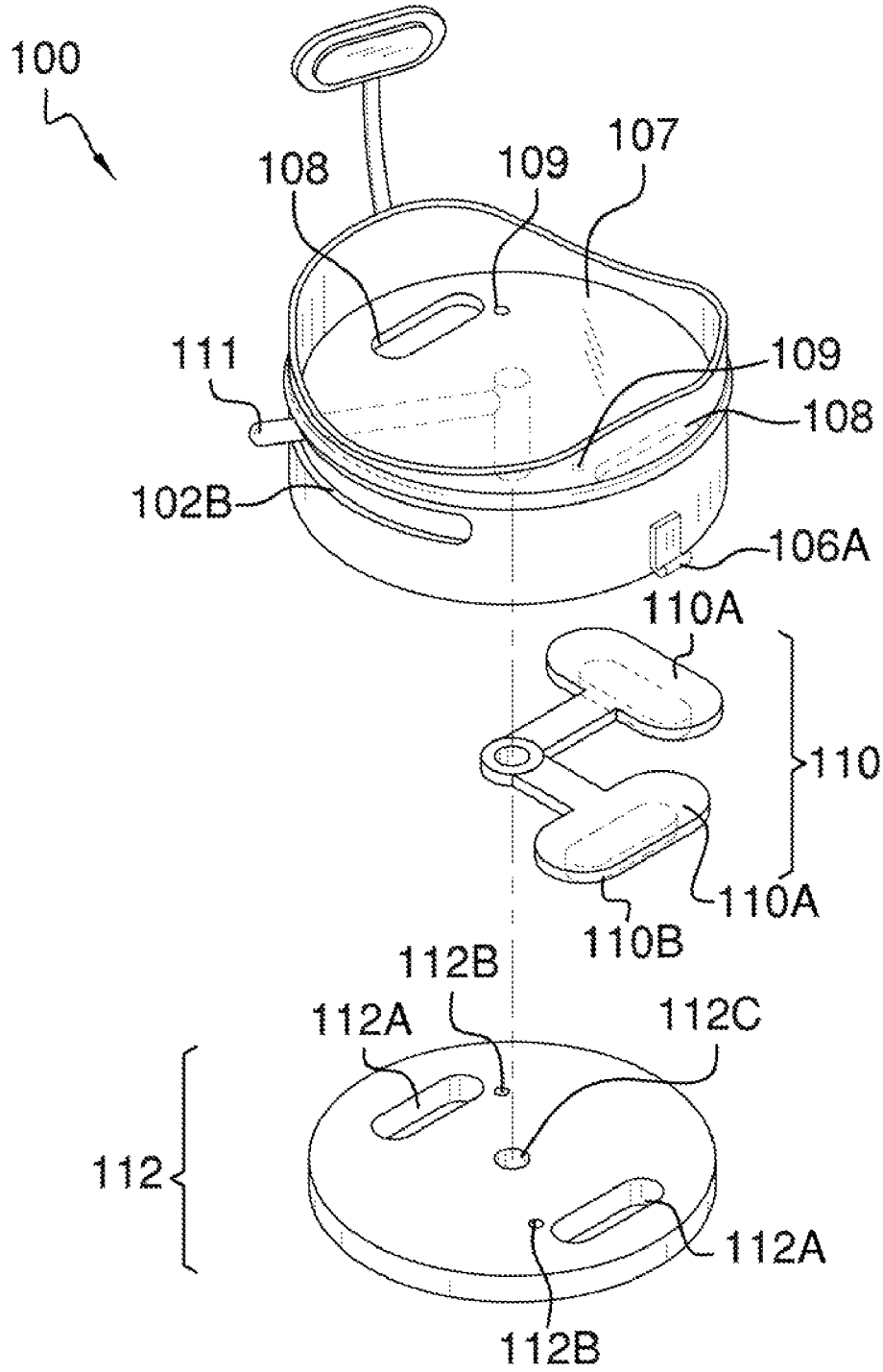
FIG. 4D illustrates an exploded view of the lid and selection stem aligned above the armature and covers used to expose and cover the different openings of the bottom disk, which is aligned there under.
Figure 5:
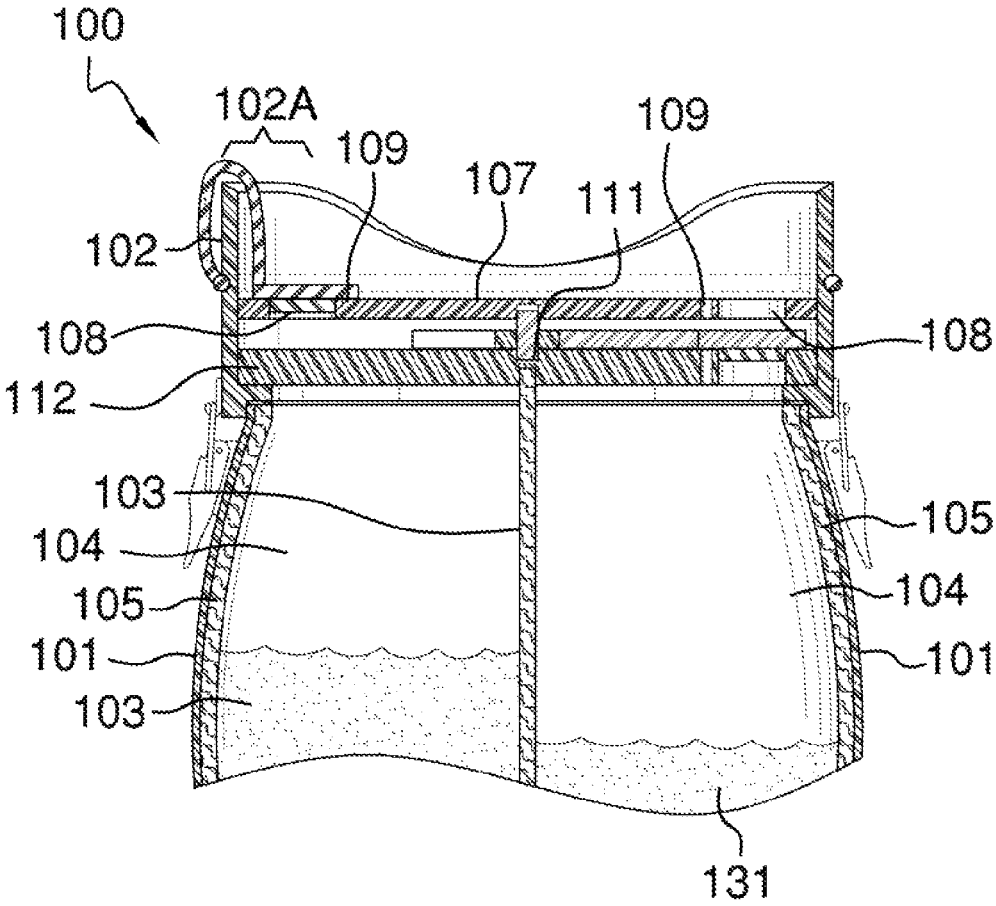
FIG. 5 illustrates a cut-away view of the traveler mug and detailing the divider within the container and the lid secured atop the container, and depicting the holes located on corresponding sipping sections as well as the cover rotated to a left side.

Referring to FIGS. 1, 3, and 4C, the invention 100 includes a mouthpiece cover 115, which is rotatably engaged with respect to the lid 102, and which includes a band 115A that is extended around an outer periphery of the lid 102. The band 115A is made of an elastic material, and can rotate around the lid 102 thereby providing alignment of the mouthpiece cover 115 to either hole 108 located on the lid 102. The mouthpiece cover 115 extends from an arm 1158. It shall be noted that the mouthpiece cover 115 may include a groove section 115C, which can be used to secure and seat the mouthpiece cover 115 onto either hole 108 of the lid 102.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A traveling mug comprising:

a container having an interior divided into a plurality of compartments via a divider;

wherein a lid is sealed atop the container via a sealing means;

wherein the lid includes a top surface under which an armature is rotatably engaged and of which rotates via a selection stem to enable selection of a beverage from a desired compartment;

wherein the lid is divisible into sipping sections that are each aligned above one of the compartments;

wherein the number of compartments located within the container shall be equal to the number of the sipping sections located on the lid;

wherein a flat surface includes holes and vents that correspond to the respective sipping sections and compartments and insure a means to drink a beverage in a laminar flow;

wherein the armature can rotate about a center of the lid; wherein the armature includes hole covers that extend radially from the center, and which are provided at a predefined arc segment, which shall correspond to the holes of the lid such that upon rotation of the selection stem, the hole covers either cover or expose access to the compartments contained under a bottom disk;

wherein the bottom disk includes bottom holes and bottom vents that correspond with and are aligned beneath the holes and vents of the lid; wherein the bottom disk also includes a selection stem hole, which enables the selection stem to rotate about the center;

wherein the hole covers of the armature each include an elevated section, which extends downwardly therefrom, and which shall engage into the respective bottom holes, and which can provide an airtight seal there with;

wherein a mouthpiece cover attaches to the lid, and which can seal off any of the holes of the lid;

wherein the mouthpiece cover extends from a band that is extended around an outer periphery of the lid; wherein the band can rotate around the lid thereby offering rotation and alignment of the mouthpiece cover adjacent one of the holes of the lid;

wherein the mouthpiece cover extends from an arm; wherein the arm is positioned between the band and the mouthpiece cover; wherein the mouthpiece cover includes a groove section, which can secure and seat the mouthpiece cover onto either hole of the lid.

2. The traveling mug as described in claim 1 wherein the container and the divider include insulating means that enable preservation of one beverage temperature in one compartment irrespective of another beverage temperature in another compartment.

3. The traveling mug as described in claim 1 wherein the securing means are located on opposing sides of the container and lid and are composed of a hook and rotating latch.

4. A traveling mug comprising:

a container having an interior divided into a plurality of compartments via a divider;

wherein a lid is sealed atop the container via a sealing means;

wherein the lid includes a top surface under which an armature is rotatably engaged and of which rotates via a selection stem to enable selection of a beverage from a desired compartment;

wherein the container and the divider include insulating means that enable preservation of one beverage temperature in one compartment irrespective of another beverage temperature in another compartment; wherein the securing means are located on opposing sides of the container and lid and are composed of a hook and rotating latch; wherein the lid is divisible into sipping sections that are each aligned above one of the compartments; wherein the number of compartments located within the container shall be equal to the number of the sipping sections located on the lid;

wherein a flat surface includes holes and vents that correspond to the respective sipping sections and compartments and insure a means to drink a beverage in a laminar flow;

wherein the armature can rotate about a center of the lid; wherein the armature includes hole covers that extend radially from the center, and which are provided at a predefined arc segment, which shall correspond to the holes of the lid such that upon rotation of the selection stem, the hole covers either cover or expose access to the compartments contained under a bottom disk;

wherein the bottom disk includes bottom holes and bottom vents that correspond with and are aligned beneath the holes and vents of the lid; wherein the bottom disk also includes a selection stem hole, which enables the selection stem to rotate about the center;

wherein the hole covers of the armature each include an elevated section, which extends downwardly therefrom, and which shall engage into the respective bottom holes, and which can provide an airtight seal there with;

wherein a mouthpiece cover attaches to the lid, and which can seal off any of the holes of the lid; wherein the mouthpiece cover extends from a band that is extended around an outer periphery of the lid; wherein the band can rotate around the lid thereby offering rotation and alignment of the mouthpiece cover adjacent one of the holes of the lid; wherein the mouthpiece cover extends from an arm; wherein the arm is positioned between the band and the mouthpiece cover; wherein the mouthpiece cover includes a groove section, which can secure and seat the mouthpiece cover onto either hole of the lid.

* * * * *